United States Patent [19]

Ehrsam

[11] Patent Number: 4,920,752

[45] Date of Patent: May 1, 1990

[54] APPARATUS AND PROCESS FOR STORING HYDRATE-FORMING GASEOUS HYDROCARBONS

[75] Inventor: Christian Ehrsam, Winterthur, Switzerland

[73] Assignee: Sulzer Brothers LImited, Winterthur, Switzerland

[21] Appl. No.: 290,437

[22] Filed: Dec. 27, 1988

[30] Foreign Application Priority Data

Jan. 14, 1988 [CH] Switzerland ..... 00132/88

[51] Int. Cl.[5] ..... F17C 11/00; 62 46.1; 62 54.1; 585 15

[52] U.S. Cl. ..... 62/46.1; 62/54.1; 585/15

[58] Field of Search ..... 62/46.1, 54.1; 585/15

[56] References Cited

U.S. PATENT DOCUMENTS

| | | | |
|---|---|---|---|
| 2,270,016 | 5/1938 | Venesh | 48/190 |
| 2,356,407 | 8/1944 | Hutchinson | 260/676 |
| 2,363,529 | 11/1944 | Hutchinson | 585/15 |
| 2,375,559 | 5/1945 | Hutchinson et al. | 423/220 |
| 3,126,334 | 3/1964 | Harlow | 585/15 |
| 3,243,966 | 4/1966 | Glew | 585/15 |
| 3,514,274 | 5/1970 | Cahn et al. | 62/54.1 |
| 3,856,492 | 12/1974 | Klass | 585/15 |
| 3,975,167 | 8/1976 | Nierman | 585/15 |

*Primary Examiner*—Ronald C. Capossela
*Attorney, Agent, or Firm*—Kenyon & Kenyon

[57] ABSTRACT

The apparatus for storing a frozen hydrate includes a reservoir which is filled with frozen granulated hydrate. Heat for decomposing the hydrate is obtained from water contained in a water tank. In one embodiment, the process is carried out in such a way that one chamber of a reservoir may be charged while another chamber is being evacuated by the decomposition of the frozen hydrate into gas and ice.

11 Claims, 2 Drawing Sheets

APPARATUS AND PROCESS FOR STORING HYDRATE-FORMING GASEOUS HYDROCARBONS

Figure 1:
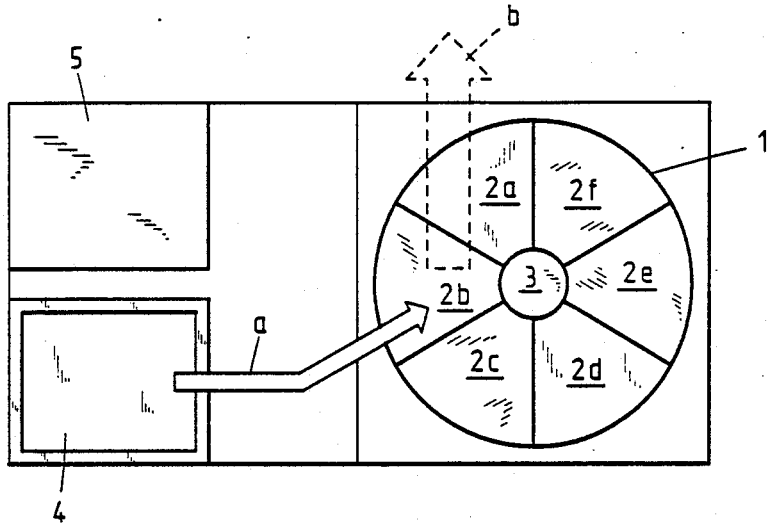

This invention relates to an apparatus and process for storing hydrate-forming gaseous hydrocarbons. More particularly, this invention relates to an apparatus and process for storing natural gas.

Heretofore, various processes have been known for the storing of hydrate-forming gaseous hydrocarbons, particularly, natural gas, the main component of which is methane. In practice, natural gas has been stored as an energy source at those times when there is little or no consumption, for example, during a warm season. Thus, by storing a natural gas which is otherwise supplied in a constant quantity during an entire year is stored during periods when not required, it is possible to supply the stored gas during a time of increased need, particularly, during a cold season. One form of natural gas storage has consisted in storing the gas in the form of hydrte, since methane which is the main component of natural gas as well as the additional components of ethane and propane undergo hydration. Other components which are not hydrocarbons, namely carbon dioxide and hydrogen sulfide, also form hydrates. Methane hydrate, for example, is known to be an ice-like solid which consists of methane and water.

U.S. Pat. Nos. 2,375,559 and 2,270,016 describe processes for storing natural gas in the form of hydrate and for decomposing the hydrate, for consumption, into released natural gas and water or ice by supplying heat and by pressure reduction. In this respect, hydration is an exothermic process in which the removal of heat is customarily performed by means of refrigeration machines. U.S. Pat. No. 2,270,016 describes a process of storing a gas hydrate, inter alia, at atmospheric pressure and approximately minus 26° F. When taken from storage, heat is used, for example the latent heat of fusion of ice or sensible heat of water.

However, the techniques which have been used for the storage and subsequent decomposition of a hydrate of a hydrocarbon have been energy intensive. In addition, where pressure reduction has been used in the decomposition process, suitable means have been necessary in order to provide for pressurization of the hydrate.

Accordingly, it is an object of the invention to be able to store a hydrocarbon hydrate in the range of atmospheric pressure and to discharge gas from the hydrate using relatively little energy.

It is another object of the invention to be able to store very large amounts of hydrocarbon hydrate in a relatively simple manner.

It is another object of the invention to be able to store and subsequently decompose hydrocarbon hydrates in an economic manner.

Briefly, the invention provides an apparatus for storing a hydrate-forming gaseous hydrocarbonas well as a process for storing a hydrate-forming gaseous hydrocarbon.

The apparatus includes a hydrate reservoir for receiving and containing a frozen hydrate in a pressure range of one atmosphere and at a temperature below the decomposition temperature of the hydrate. The apparatus also includes a hydrate forming installation for suppling frozen hydrate to the reservoir and a water tank which is connected to one of the reservoir and installation in order to supply heat thereto for decomposition of frozen hydrate in the reservoir.

The reservoir may be constructed so as to have a plurality of chambers for receiving frozen hydrate as well as a common distributor for supplying hydrate from the hydrate forming installation to the chambers of the reservoir.

In one embodiment, the water tank is connected with the reservoir in order to deliver water thereto.

In another embodiment, the water tank is connected to the hydrate forming installation while a means is provided for passing gas evolved from the reservoir into heat exchange with the delivered water from the tank in order to heat the gas. In addition, a means is provided for supplying this heated gas to the reservoir to decompose the hydrate therein, when required, into gas and ice.

In still another embodiment, the water tank may be connected to the hydrate forming installation to deliver water thereto for extracting heat therefrom for use in heating gas evolved from and recycled to the hydrate reservoir. In this embodiment also, means are provided for wetting the recycled gas prior to be supplied to the reservoir.

The hydrate forming installation includes two refrigerating machines. One refrigerating machine is used to form hydrate at a temperature of 0° C. and about 30 bars while the second refrigerating machine operates to freeze the hydrate to about minus 30° C. Thus, the hydration need not proceed completely in the first refrigeration machine, that is, excess water may still be present. The second refrigerating machine serves to cool the hydrate sufficiently for storage and at a desired storage pressure of about one atmosphere as the hydrate would otherwise decompose. During freezing in the second refrigerating machine, the excess water freezes out. The resulting product consisting of hydrate and ice is the frozen hydrate which is to be stored.

The process comprises the steps of freezing a gaseous hydrocarbon to a hydrate, delivering the frozen hydrate, for example in particle form into a reservoir in a pressure range of one atmosphere and at a temperature below the decomposition temperature of the hydrate, subsequently supplying water to the reservoir from a water tank to decompose the frozen hydrate into gas and ice and thereafter removing the gas from the reservoir.

The step of heating the ice in the reservoir may be accomplished using the heat which is released during hydration of the gaseous hydrocarbon in order to melt the ice to water. In addition, some of the melt water may be removed for subsequent freezing of the gaseous hydrocarbon in the hydrate forming installation while the remainder of the melt water is used for recycling to the water tank.

Where the reservoir is provided with a plurality of individual chambers, ice may be melted successively out of the individual chambers while frozen hydrate is charged successively into the evacuated chambers.

In accordance with the process, the hydrate may be granulated prior to delivery to the reservoir and conveyed pneumatically via the gaseous hydrocarbon.

The invention thus provides an apparatus and process which makes possible the charging and discharging of a reservoir under conditions which are favorable in the terms of energy consumption.

The discharging of the reservoir is particularly achieved with a minimum of energy as the hydrate is decomposed into gas and ice. In this respect, the hydrate is not melted to release the gas.

In addition, the use of a water tank provides an energy source wherein the needed heat of decomposition can be given off cost-effectively due to the phase transformation of liquid water from the water tank into ice with the release of latent heat.

Another advantage is that the ice which remains in the reservoir after decomposition of the hydrate and the ice which is formed from the water of the water tank serve in the renewed production of hydrate as a heat sink at 0° C. This means that there is a reduced need for mechanical energy in the refrigerating machines of the hydrate forming installation.

Figure 2:
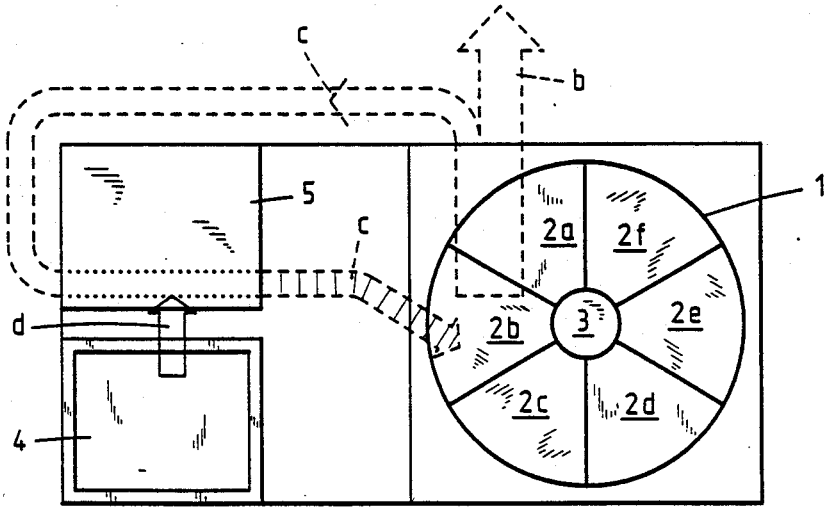
Figure 3:
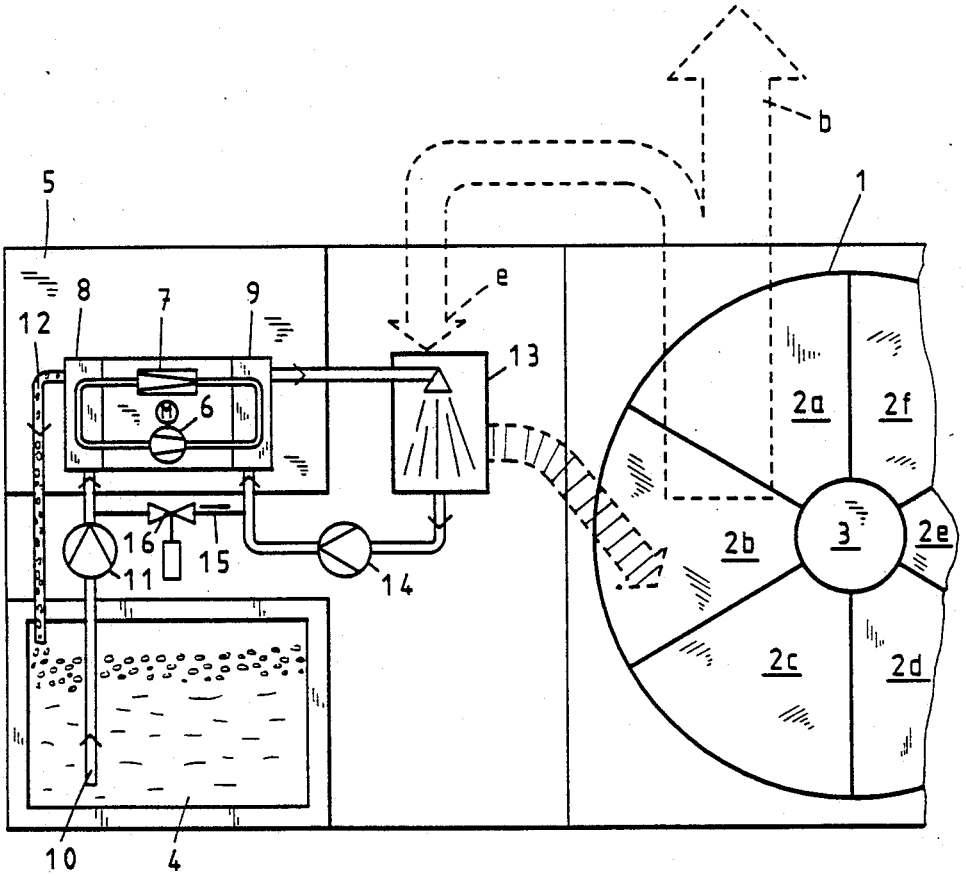
Figure 4:
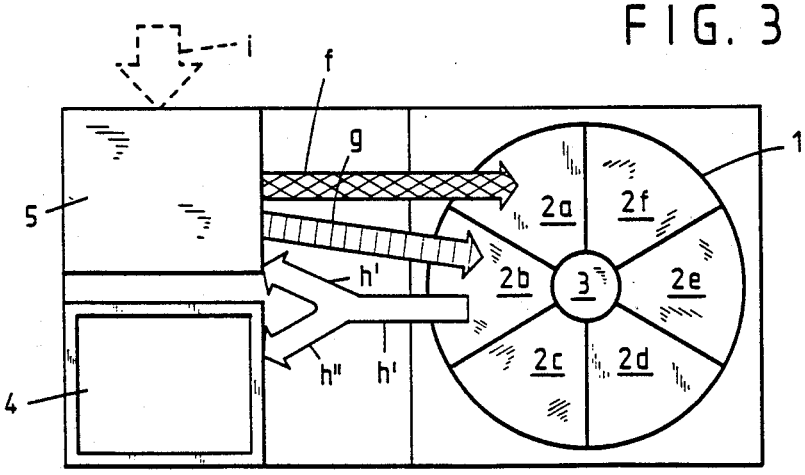

These and other objects and advantages of the invention will become more apparent from the following detailed description taken in conjunction with the accompanying drawings wherein:

FIG. 1 schematically illustrates an apparatus in accordance with the invention utilizing water from a water tank for decomposing hydrate in a hydrate reservoir;

FIG. 2 schematically illustrates an apparatus in accordance with the invention wherein water from a water tank and gas evolved from a hydrate reservoir are used for the decomposition of a stored hydrate;

FIG. 3 illustrates a further embodiment of an apparatus in accordance with the invention wherein the gas for decomposing the hydrate in the reservoir is heated and wetted; and FIG. 4 illustrates a further embodiment in which hydrate is formed and ice remaining in the reservoir is simultaneously melted.

The drawings illustrates schematic representations of the structural elements need for an understanding of the invention. That is, not all the pumps, water conduits, valves and the physical construction of a hydrate producing installation and the reservoir are shown.

Referring to FIG. 1, the apparatus for storing hydrate-forming gaseous hydrocarbons includes a hydrate reservoir 1 consisting of six chambers 2*a*, 2*f* each of which is closed off from the other and which are arranged circumferentially about a central common distributor 3, not shown in detail for supplying hydrate to the chambers. In addition, a water tank 4 is connected to the reservoir 1 for supplying water thereto as explained below. In addition, a hydrate forming installation of generally known construction is provided for supplying frozen hydrate to the reservoir 1.

In the condition shown, the reservoir 1 is filled with frozen hydrate in a state suitable for discharge. In this respect, the frozen hydrate is stored in a pressure range of one atmosphere and at a temperature below the decomposition temperature of the hydrate.

During operation, in order to decompose the hydrate in the reservoir 1, water is supplied from the water tank 4 via suitable conduits (not shown) and identified by the arrow a. The water from the tank 4 has a temperature above the freezing point. As an example, the water in the tank 4 can be heated by utilizing the waste heat occurring in the hydrate-forming installation 5.

The water is introduced into the reservoir 1 via the distributor 3 into all of the chambers 2*a*–2*f* simultaneously. The water penetrates into the frozen hydrate which is in the form of a porous bulk material of granulated particles and which is at a temperature, for example, of minus 30° C. Due to the heat supplied by the water, the hydrate decomposes into gas and ice. The gas which is released is then sent to a suitable destination, for example, in the direction indicated by the arrow b. The water from the water tank 4 cools off during the decomposition of the hydrate at least to its freezing point and remains as ice in the reservoir 1 together with the ice from the decomposed hydrate. Hence, upon cooling of the water to freezing point, the latent heat of the supplied water becomes available for the decomposition of the hydrate. Likewise, when the water is introduced at elevated temperature into the reservoir 1, the sensible heat also becomes available for the decomposition of the hydrate. That is, there remains in the reservoir 1 this formed ice together with the ice formed during hydrate decomposition until renewed charging of the reservoir.

Referring to FIG. 2, wherein like reference characters indicate like parts as above, the water from the water tank 4 is delivered to the hydrate forming installation 5. In addition, a means, for example in the form of conduits is provided for passing at least a portion of the evolved gas from the reservoir 1 in the direction indicated by the arrow c for heat exchange with the water from the tank 4 in order to heat the gas while cooling the water. The resulting heated gas is then passed by suitable means, such as conduits, to the reservoir 1 for the decomposition of the hydrate therein into gas and ice.

The gas which is recycled to the reservoir 1 may be a partial quantity of released gas or gas which did not lead to hydrate formation during charging but which has remained gaseous.

The heat transfer between the water delivered from the tank 4 and the recycled gas may take place in a refrigerating machine (not shown) which is operated as a heat pump. As indicated , the heat withdrawn from the water tank 4 is transferred in the direction of the arrow d whereby the water in the tank 4 cools to form ice.

Referring to FIG. 3, wherein like reference characters indicate like parts as above, the gas which is recycled to the reservoir 1 may not only be heated but also wetted. In this case, a refrigerating machine of the hydrate-forming installation 5 is operated as a heat pump and includes a compressor 6, a throttle 7, an evaporator 8 and a condenser 9. In addition, the latent heat of the water in the water tank 4 is used with the water in the tank 4 freezing at least for the most part. As indicated, the water from the water tank 4 is conveyed through a conduit 10 into the evaporator 8 by means of a circulating pump 11 of the refrigerating machine. After evaporation of the refrigerant of the refrigerating machine, the water cools at least partially to its freezing point and a mixture of ice and cooled water is returned into the water tank through a conduit 12.

As indicated, water is circulated through the condenser 9 to a spray heat exchanger 13 via a circulating pump 14. In addition, gas from the reservoir 1 is delivered via a suitable conduit in the direction indicated by the arrow e and is directed into the spray heat exchanger 13 to be heated and wetted with the water prior to being recycled to the reservoir 1. The water losses resulting in the heat exchanger 13 are covered by the water tank 4 via a conduit 15 in which a control valve 16 is positioned.

This embodiment presents several advantages. First, as a result of the water being introduced into the gas for wetting purposes and which is condensed out and frozen out in the reservoir 1, less gas must be circulated. As compared with the embodiment of FIG. 1, wherein clogging of the pores of the frozen hydrate may possibly occur, clogging is prevented in the embodiment of FIG. 3 with certainty, namely, for the reason that a relatively smaller amount of water is separated in the reservoir 1.

Referring to FIG. 4, wherein like reference characters indicate like parts as above, the reservoir may be operated so as to be in a state of evacuation and a state of charging simultaneously.

As indicated, evacuation of the reservoir 1 occurs by melting of the ice contained n the chambers 2*a*, 2*f*. To this end, heated water is used. After a first chamber 2*a* has been evacuated, charging of this chamber with hydrate can begin as indicated schematically by the arrow f. The heating of the water for melting can now occur through the heat released during hydration. This heat transport is symbolized by the arrow g.

The transport of the melt water from the chamber 2*b* into the hydrate forming installation 5 or into the water tank 4 is symbolized by the arrows h, h', h''. Most of the melt water is utilized for hydrate production. With this procedure, one chamber of the reservoir 1 is evacuated while another chamber is charged with hydrate.

As indicated in FIG. 4, the feed of product to be hydrated is indicated by an arrow i.

The transport of the hydrate into the reservoir 1 may occur in various manners (not shown). For example, the hydrate may be transported into the reservoir 1 pneumatically with the natural gas a transport medium. The mixture of gas in frozen hydrate can be feed into the chambers via a distributor 3 disposed in the center of the reservoir 1. Also, the use of conveyor belts is possible for the transport of the frozen hydrate.

As noted above, the hydrate forming installation 5 includes a refrigerating machine with which the actual hydrate formation occurs at 0° C. and about 30 bars and the product of this hydrate formation which is not yet stable at ambient pressure is now frozen out by means of a second refrigerating machine (not shown) and cooled to about minus 30° C. At the same time, a pasty hydrate/water mass is granulated. This second process step which comprises freezing, cooling and granulation can be realized, for example, by a fluidized bed technique.

The frozen hydrate is generally deposited in the chambers of the reservoir 1 as a bulk material while the transport gas is pumped off and recycled.

The invention thus provides an apparatus and process whereby hydrate-forming gaseous hydrocarbons can be stored in a cost-effective manner particularly since the hydrate can be stored at about atmospheric pressure. In addition, the hydrate can be readily decomposed using the heat from a relatively inexpensive heat source, namely water in a water tank.

What is claimed is:

1. An apparatus for storing hydrate-forming gaseous hydrocarbons, said apparatus comprising:
   - a hydrate reservoir having at least one chamber for storing a frozen hydrate in a pressure range of one atmosphere and at a temperature below the decomposition temperature of the hydrate;
   - a hydrate forming installation for supplying frozen hydrate to said chamber;
   - a water tank connected to said installation to deliver water thereto;
   - first means for passing gas evolved from said chamber in heat exchange relation with the water from said tank to heat the gas while cooling the water; and
   - second means for supplying the heated gas to said chamber to decompose the hydrate therein into gas and ice.

2. An apparatus as set for in claim 1 wherein said installation includes a first refrigerating machine to form hydrate at a temperature of 0° C. and about 30 bars and a second refrigerating machine to freeze the hydrate to about −30° C.

3. An apparatus as set forth in claim 1 which further comprises means for wetting the gas prior to being supplied to said chamber.

4. An apparatus as set forth in claim 1 wherein said first means passes the gas through said installation.

5. An apparatus as set forth in claim 1 wherein said installation includes a heat exchanger for passing the gas in heat exchange with a flow of water to heat the gas and a refrigerating machine for extracting heat from the water delivered to said installation and transferring the extracted heat to the water flowing to said heat exchanger.

6. An apparatus for storing hydrate-forming gaseous hydrocarbons, said apparatus comprising
   - a hydrate reservoir having a plurality of chambers for storing frozen hydrate;
   - a hydrate forming installation for receiving and freezing a gaseous hydrocarbon for selective supplying as frozen hydrate to said chambers;
   - a water tank for supplying water to at least one of said reservoir chambers to decompose the frozen hydrate therein into gas and ice while freezing the supplied water into ice; and
   - means for supplying melt water from said chamber to said installation as a refrigeration source for cooling and hydration of a gaseous hydrocarbon therein.

7. A process of storing a hydrate-forming gaseous hydrocarbon comprising the steps of
   - freezing a gaseous hydrocarbon to a hydrate;
   - delivering the frozen hydrate in particle form into a reservoir in a pressure range of one atmosphere and at a temperature below the decomposition temperature of the hydrate;
   - obtaining a supply of heat from water in a water tank while cooling the water in the tank;
   - heating a flow of gas from the reservoir with the heat obtained from the water of the water tank; and
   - supplying the heated gas to the reservoir to decompose the frozen hydrate therein into gas and ice.

8. A process as set forth in claim 7 which further comprises the step of wetting the gas supplied to the reservoir with water from the water tank.

9. A process as set forth in claim 7 which further comprises the steps of heating the ice in the reservoir with heat released during hydration of the gaseous hydrocarbon to melt the ice to water, removing same of the melt water for subsequent freezing of gaseous hydrocarbon and removing the remainder of the melt water for re-cycling to the water tank.

10. A process as set forth in claim 9 wherein ice is melted successively out of individual chambers of the reservoir and frozen hydrate is charged successively into the evacuated chambers.

11. A process as set forth in claim 7 wherein the hydrate is pneumatically conveyed to the reservoir by gaseous hydrocarbon.

* * * * *

UNITED STATES PATENT AND TRADEMARK OFFICE
CERTIFICATE OF CORRECTION

PATENT NO. : 4,920,752

DATED : May 1, 1990

INVENTOR(S) : CHRISTIAN EHRSAM

It is certified that error appears in the above—identified patent and that said Letters Patent is hereby corrected as shown below:

Column 1, line 22 "hydrte" should be -hydrate-
Column 2, line 23 "be" should be -being-
Column 3, line 35 "need" should be -needed-
Column 5, line 12 "n" should be -in-
Column 5, line 32 "feed" should be -fed-
Column 6, line 34 "chamber" should be -chambers-

Signed and Sealed this

Twenty-third Day of July, 1991

*Attest:*

HARRY F. MANBECK, JR.

*Attesting Officer*

*Commissioner of Patents and Trademarks*